US011638503B1

(12) United States Patent
Youdovin

(10) Patent No.: US 11,638,503 B1
(45) Date of Patent: May 2, 2023

(54) ON DEMAND ELECTROMECHANICAL DISPENSER OF CLEANING SOLUTION

(71) Applicant: Everybody Cleanup, P.B.C., New York, NY (US)

(72) Inventor: David N. Youdovin, New York, NY (US)

(73) Assignee: Everybody Cleanup, P.B.C., New York, NY (US)

( * ) Notice: Subject to any disclaimer, the term of this patent is extended or adjusted under 35 U.S.C. 154(b) by 0 days.

(21) Appl. No.: 17/935,182

(22) Filed: Sep. 26, 2022

(51) Int. Cl.
*A47K 5/12* (2006.01)

(52) U.S. Cl.
CPC ..... *A47K 5/1217* (2013.01)

(58) Field of Classification Search
CPC ..... A47K 5/1217; A47K 5/1212; A47K 5/12
USPC ..... 222/52, 1, 333, 63, 71, 231, 7, 231.9, 222/412; 141/351
See application file for complete search history.

(56) References Cited

U.S. PATENT DOCUMENTS 9,980,615 B1 * 5/2018 Maercovich ..... A47K 5/1211
2004/0050875 A1 * 3/2004 Kobayashi ..... G01F 13/005 222/383.2
2004/0226962 A1 * 11/2004 Mazursky ..... A47K 5/1217 222/64
2005/0279783 A1 * 12/2005 Lo ..... B05B 12/122 222/639
2007/0000941 A1 * 1/2007 Hadden ..... A47K 5/1217 222/63
2008/0185396 A1 * 8/2008 Yang ..... A47K 5/1217 222/644
2009/0026225 A1 * 1/2009 Lickstein ..... B05B 9/0861 222/325
2012/0241470 A1 * 9/2012 Snodgrass ..... A61L 2/0088 222/639
2014/0231450 A1 * 8/2014 Rosko ..... A47K 5/1211 222/52
2017/0190565 A1 * 7/2017 Proper ..... B67D 7/84
2021/0378459 A1 * 12/2021 Yang ..... B65D 25/00

* cited by examiner

*Primary Examiner* — Lien M Ngo
(74) *Attorney, Agent, or Firm* — Alston & Bird LLP

(57) ABSTRACT

A dispenser comprising a cover housing, main housing, and base housing is provided. The cover housing includes an upper housing including a dispensing mechanism for dispensing cleaning solution from a holding reservoir. The main housing includes a cleaning solution storage reservoir, and a positive-displacement mechanism for electromechanically transporting cleaning solution from the storage reservoir to the holding reservoir. The base housing includes a ratcheting mechanism for causing the positive-displacement mechanism to rotate, and a power-spring mechanism for generating resistance against the ratcheting mechanism. The dispenser further includes a microprocessor configured to receive a signal indicating a sensing system has identified a dispense trigger, relay a signal to a pump motor to operate accordingly, determine that the holding reservoir is to be refilled, and actuate the positive-displacement mechanism to refill the holding reservoir. The dispenser further includes an electrical power system for supplying electrical power to electrical components of the dispenser.

20 Claims, 5 Drawing Sheets

ON DEMAND ELECTROMECHANICAL DISPENSER OF CLEANING SOLUTION

TECHNICAL FIELD

Various embodiments generally relate to a dispenser for dispensing solutions, such as cleaning solutions. For example, various embodiments relate to dispensers comprising a dispensing system that utilizes a positive-displacement mechanism.

BACKGROUND

Various conventional solution dispensers require a user to touch the dispenser. For example, a user may push down on a hand pump dispenser to cause hand soap to be dispensed therefrom. Conventional touch-free dispensers tend to depend on gravity to enable the hands-free dispensing of hand soap or other solutions. This dependence on gravity requires the touch-free dispenser to be mounted on a wall, for example, so that a receiver of the hand soap or other solution may be placed under the dispenser to receive the hand soap or other solution.

BRIEF SUMMARY

Example embodiments provide a dispenser configured to store cleaning solutions and dispense cleaning solutions therefrom. Example embodiments provide a hands-free dispenser that may be placed on a countertop, table, and/or the like and dispense cleaning solution (e.g., hand soap or other cleaning solution) therefrom. In various embodiments, the dispenser comprises dispensing mechanism that utilizes a positive displacement mechanism to transport cleaning solution to a top of the dispenser such that when a sensor of the dispenser causes a dispense event to occur, the cleaning solution is dispensed from a top portion of the dispenser. In various embodiments, the cleaning solution may be glass cleaning solution, bath cleaning solution, general purpose kitchen cleaning solution, metal cleaning solution, hand soap, dish soap, laundry stain remover, scent neutralizing solution, air freshener, laundry detergent, and/or the like. Some example embodiments of the present invention provide a user with a single use amount of cleaning solution per dispense event.

According to one aspect, a dispenser for dispensing a cleaning solution from a reservoir is provided. In an example embodiment, the dispenser comprises a cover housing, configured with an upper housing, main housing, and base housing. The upper housing comprises at least a portion of a dispensing mechanism configured for electromechanically dispensing cleaning solution from a holding reservoir.

Another aspect provides the cover housing comprises a main housing configured with a cleaning solution storage reservoir and a positive-displacement mechanism configured for electromechanically transporting cleaning solution from the storage reservoir to the holding reservoir. Additionally, the cover housing comprises a base housing disposed within which is a ratcheting mechanism configured to allow the positive-displacement mechanism to rotate in a single rotational direction and a power-spring mechanism configured to generate resistance against the ratcheting mechanism. The present invention also provides an electrical power system configured to supply electrical power to components of the dispensing mechanism and the positive-displacement mechanism.

In an example embodiment, the storage reservoir disposed within the main housing is at least partially filled with cleaning solution. Following activation of a motion-detecting sensor, a servo motor rotates a positive-displacement mechanism within the main housing. The cleaning solution is transported via the positive-displacement mechanism up into a holding reservoir. A pump motor then expels a dose of the cleaning solution out of a dispenser discharge. In an example embodiment, a ratcheting mechanism prevents the positive-displacement mechanism from turning in the undesired rotational direction as the servo motor returns to its initial orientation.

DETAILED DESCRIPTION

The present invention now will be described more fully hereinafter with reference to the accompanying drawings, in which some, but not all embodiments of the invention are shown. Indeed, this invention may be embodied in many different forms and should not be construed as limited to the embodiments set forth herein; rather, these embodiments are provided so that this disclosure will satisfy applicable legal requirements. The term "or" (also denoted "/") is used herein in both the alternative and conjunctive sense, unless otherwise indicated. The terms "illustrative" and "Example" are used to be examples with no indication of quality level. The terms "generally" and "approximately" refer to within engineering and/or manufacturing limits and/or within user measurement capabilities, unless otherwise indicated. Like number refer to like elements throughout.

Example Cover Housing

Figure 1:
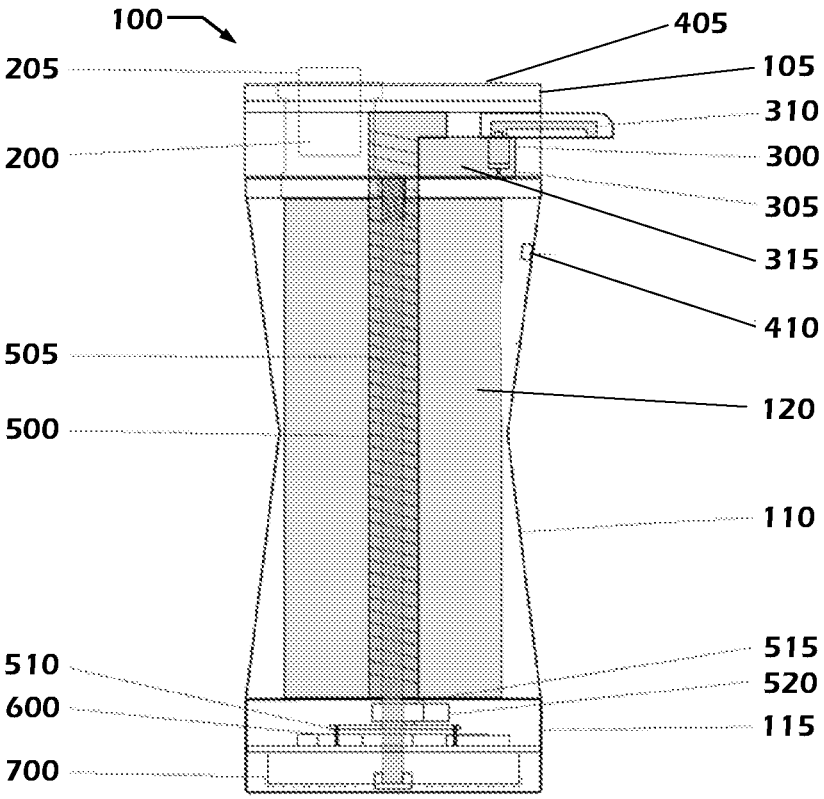
FIG. 1 illustrates a cross-sectional side view of a dispenser in accordance with an example embodiment.

FIG. 1 provides a cross-sectional side view of a dispenser 10 in accordance with an example embodiment. In various embodiments, the dispenser 10 comprises a cover housing 100. In various embodiments, the cover housing 100 is configured to mechanically accommodate and/or comprise an upper housing 105, a main housing 110, and a base housing 115. The upper housing 105 comprises a retaining-ejecting mechanism 200 and a dispensing mechanism 300. The main housing comprises a cleaning solution storage reservoir 120 and a positive-displacement mechanism 500. The base housing 115 comprises a ratcheting mechanism 600 and a power-spring mechanism 700.

In an example embodiment, the upper housing 105 is mechanically fixed to the main housing 110 via an attachment surface (e.g., threads, compression fit, etc.) shared and/or mated between the two bodies. For example, the upper housing 105 comprises an attachment surface comprising threads, a compression fit surface, and/or the like and the main housing 110 comprises an attachment surface comprising threads, a compression fit surface, and/or the like configured to be mated and/or coupled to the upper housing 105 attachment surface, in various embodiments. In an example embodiment, the main housing 110 is mechanically fixed to the base housing 115 via an attachment surface shared and/or mated between the two bodies. For example, the main housing 110 comprises an attachment surface comprising threads, a compression fit surface, and/or the like and the base housing 115 comprises an attachment surface comprising threads, a compression fit surface, and/or the like configured to be mated and/or coupled to the main housing 110 attachment surface. In an example embodiment, the upper housing 105 is incorporated in the design of and/or integrally formed with the main housing 110. In an example embodiment, the main housing 110 is incorporated in the design of and/or integrally formed with the base housing 115. In various embodiments, the cover housing 100 may be configured with any of the aforementioned example embodiments or a combination thereof.

Example Retaining-Ejecting Mechanism

In various example embodiments, the retaining-ejecting mechanism 200 enables a pod 205 to be inserted into a retained position at least partially within the recess 210, retained in the retained position, and released from the retained position following designated user input. The pod 205 may be configured to contain a desired dosage of concentrated powder or cleaning solution.

In various embodiments, the retaining-ejecting mechanism 200 is similar to that disclosed by U.S. application Ser. No. 17/813,697, filed Jul. 20, 2022, the content of which is incorporated herein by reference in its entirety. For example, a retaining-ejecting mechanism 200 may be incorporated into the housing of various types of dispensers and/or cleaning devices such that the retaining-ejecting mechanism 200 may be used to receive a pod 205 containing a concentrated cleaning medium and cause the concentrated cleaning medium to be provided to a cleaning solution storage reservoir of the dispenser and/or cleaning device for dilution and/or use.

Figure 2:
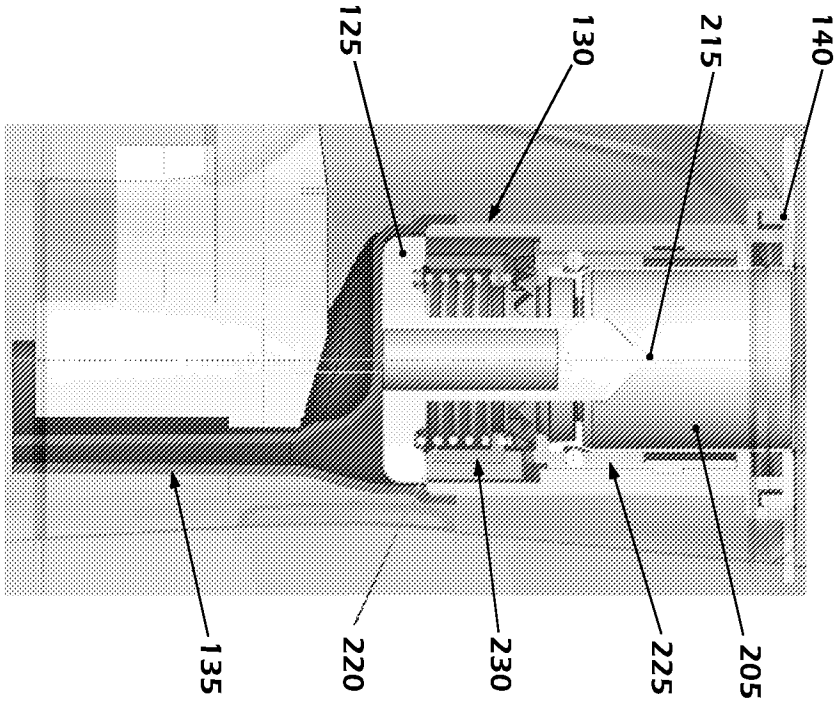
FIG. 2 illustrates a cross-sectional side view of a retaining-ejecting mechanism in accordance with an example embodiment.

FIG. 2 provides a cross-sectional side view of the retaining-ejecting mechanism 200 in accordance with an example embodiment. A chamber 130 is configured within the body of the cover housing 100, providing a recess 210 for the retaining-ejecting mechanism 200. A lower chamber wall 125 is configured at the bottommost region of the chamber 130, supporting a puncture tool 215, wherein the puncture tool 215 is configured to puncture a pod 205 when inserted into the retained position of the retaining-ejecting mechanism 200. The pod 205 is placed onto an insert guide 225 when inserted into the chamber 130. The insert guide 225 provides a unidirectional translation of the pod 205 to the puncture tool 215 when pressed into the retained position. A spring 220 is configured to release compression force to expel the pod 205 from the retained position of the retaining-ejecting mechanism 200 following an additional pressing of the pod 205 in a downward motion. The spring 220 is guided and/or contained by a spring retainer 230 configured to prevent the spring 220 from extending past a desired length. In an example embodiment, at least one drain channel 135 may be configured at the base of the lower chamber wall 125 to capture the released cleaning medium from the pod 205 and allow passage of the cleaning medium from the retaining-ejecting mechanism 200 to the storage reservoir 120 accordingly.

In various embodiments, the cleaning solution storage reservoir 120 is configured for receiving pre-diluted and/or ready-to-use cleaning solution and may not comprise a retaining-ejecting mechanism. In an example embodiment, the upper housing 105 comprises a filling port in place of the illustrated retaining-ejecting mechanism 200 and/or another mechanism for providing concentrated and/or ready-to-use cleaning solution to the cleaning solution storage reservoir 120 (e.g., from a pod 205 and/or the like). In an example embodiment, the filling port may allow direct injection of a pre-diluted and/or deconcentrated cleaning solution into the storage reservoir 120 within the main housing 110. In an example embodiment, the filling port may be incorporated in applications where several dispensers are in a cleaning area and tied together via a centralized fill location, requiring a single concentrated cleaning pod 205 or one filling port to insert the pre-diluted and/or deconcentrated cleaning solution.

In various embodiments, the upper housing 105 comprises a capsule and/or pod chamber configured to receive a pod 205 therein as disclosed by U.S. Pat. No. 10,682,658, issued Jun. 16, 2020, or U.S. Pat. No. 11,359,952, issued Jun. 14, 2022, the contents of which are hereby incorporated by reference in their entireties. Various other mechanisms, structures, and/or the like may be used to provide concentrated cleaning solution, pre-diluted and/or deconcentrated cleaning solution, a dilution chemical and/or liquid, and/or ready-to-use cleaning solution to the storage reservoir 120, in various embodiments.

Example Dispensing Mechanism

In various embodiments, the dispenser 10 comprises a dispensing mechanism 300. In various embodiments, the dispensing mechanism 300 is configured to dispense cleaning solution from the storage reservoir 120, possibly in measured and/or allotted amounts. In various embodiments, the dispensing mechanism 300 is disposed within and/or part of the upper housing 105.

In various example embodiments, the dispensing mechanism 300 comprises a pump motor 305, a dispenser discharge 310, and a holding reservoir 315. The pump motor 305 is used to pump cleaning solution from the holding reservoir 315 out of the dispenser discharge 310. In an example embodiment, the dispenser discharge 310 is configured as the outlet for all contained cleaning solution within the cover housing 100. In an example embodiment, the dispenser discharge 310 may be configured as any or a combination of the following: hand spout, foaming nozzle, pressure nozzle, etc.

In an example embodiment, the pump motor 305 replaces the user actuated mechanisms (e.g., hand pump, hand-pumped foaming nozzle, trigger pull, etc.) of conventional cleaning solution dispensers with a touchless, automated procedure for dispensing. In an example embodiment, the pump motor 305 is used to transport a measured amount of cleaning solution designated for a single use application. In an example embodiment, the pump motor 305 is a more efficient and/or effective method of transporting the single use amount of cleaning solution per dispense event compared to the larger positive-displacement mechanism 500.

In an example embodiment, the holding reservoir 315 may be configured to hold a single use measured amount of cleaning solution, such that the positive displacement mechanism 500 is configured to fill the holding reservoir 315 when it is empty and then the pump motor 305 is configured to dispense the single use measured amount of cleaning solution from the holding reservoir 315 upon actuation of the dispenser 10 (e.g., responsive to a dispense trigger identified and/or activated via a sensor 410).

Example Positive-Displacement Mechanism

In various embodiments, the dispenser 10 comprises a positive-displacement mechanism 500. In various embodiments, the positive displacement mechanism 500 is configured to transport cleaning solution from the storage reservoir 120 to the holding reservoir 315, possibly following a low-level sensor indication and/or command. In various embodiments, the positive displacement mechanism 500 is disposed within and/or a part of the main housing 110.

In various example embodiments, the positive-displacement mechanism 500 is used to transport cleaning solution from within the main housing 110 vertically towards the upper housing 105 and into the holding reservoir 315. In an example embodiment, the positive-displacement mechanism 500 is configured as an Archimedes-style screw pump. The positive-displacement mechanism 500 is supported by a drive shaft 505, stretching between the upper housing 105 and the base housing 115. In an example embodiment, the drive shaft 505 is electromechanically rotated by a microprocessor-driven servo motor 515. In an example embodiment, a microprocessor 520 is configured to enabled automated dispensing techniques of the dispenser.

In an example embodiment, the positive-displacement mechanism 500 may be used to transport a larger volume of diluted and/or deconcentrated cleaning solution from the storage reservoir 120 to the holding reservoir 315 where the pump motor 305 can deliver a desired number of smaller volume single use amounts of cleaning solution without engaging the positive displacement mechanism 500 each time.

In an example embodiment, the servo motor 515 is configured at the base of the drive shaft 505 near the base housing 115. In an example embodiment, the positive-displacement mechanism 500 is configured to rotate in the counter-clockwise (CCW) direction axially when facing downward at the top of the cover housing 100.

In an example embodiment, the microprocessor 520 is programmed to automatically dispense a single use amount of cleaning solution per dispense event following the received signal of the dispense trigger identified and/or activated via a sensor 410. In an example embodiment, after a number of single use discharges have been performed, the microprocessor may enable the positive-displacement mechanism 500 to actuate to refill the holding reservoir 315 for the pump motor 315.

Example Ratcheting Mechanism

In various embodiments, the dispenser 10 comprises a ratcheting mechanism 600. In various embodiments, the ratcheting mechanism 600 is configured to unidirectional rotation of the positive displacement mechanism 500, possibly toggleable between one or more rotational directions. In various embodiments, the ratcheting mechanism 600 is disposed within and/or a part of the base housing 115.

Figure 3:
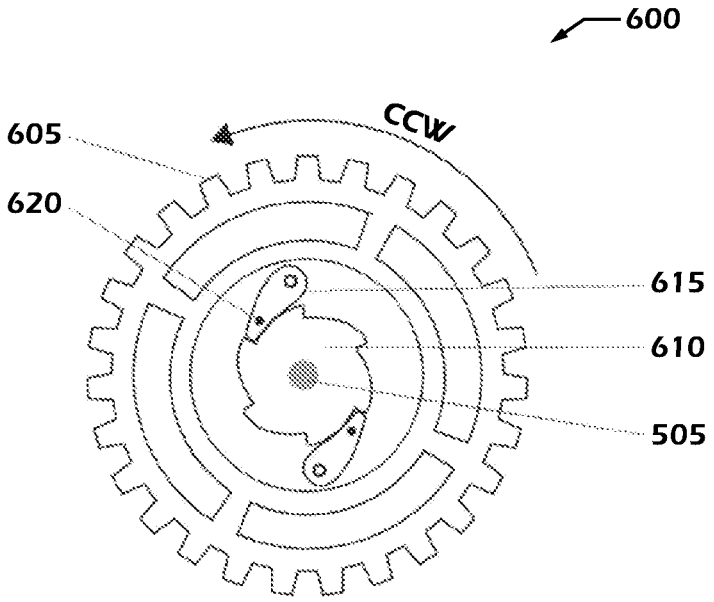
FIG. 3 illustrates a top view of a ratcheting mechanism in accordance with an example embodiment.

FIG. 3 provides a top view of a ratcheting mechanism 600 in accordance with an example embodiment. In various example embodiments, the ratcheting mechanism 600 provides a singular direction of powered rotation of the positive-displacement mechanism 500. The positive-displacement mechanism 500 is enabled in the CCW direction as shown in FIG. 3. This allows the servo motor 515 to reset to its initial orientation without rotating the positive-displacement mechanism 500 backwards into the opposing clockwise (CW) direction.

In an example embodiment, an activation rod 510 may be lifted or removed from the servo pin connection 620 of the pawl 615. This action allows the ratchet 610 to rotate freely. In an example embodiment, removing the activation rod 510 from the servo pin connection 620 enables the ratchet to rotate in the CCW rotational direction.

In an example embodiment, the activation rod 510 may be configured as a toggleable switch to provide a simplified reversal of the ratcheting mechanism 600 direction. In an example embodiment, the ratcheting mechanism 600 may require reversal of the powered direction to accommodate a mirrored drive shaft 505. In an example embodiment, various directions of the positive-displacement mechanism 500 may be desired to accommodate a variety of applications (e.g., dispenser discharge designs, holding reservoir designs, pump motor model, etc.). In an example embodiment, the ratcheting mechanism 600, wherein the activation rod 510 is configured as a toggleable switch, is configured to toggle between various gear ratios, thus changing the torque output and speed of the positive-displacement mechanism 500.

Example Power-Spring Mechanism

In various embodiments, the dispenser 10 comprises a power-spring mechanism 700. In various embodiments, the power-spring mechanism 700 is configured to provide a constant spring force against the rotational direction of the ratcheting mechanism 600. In various embodiments, the power-spring mechanism 700 is disposed within and/or a part of the base housing 115.

Figure 4:
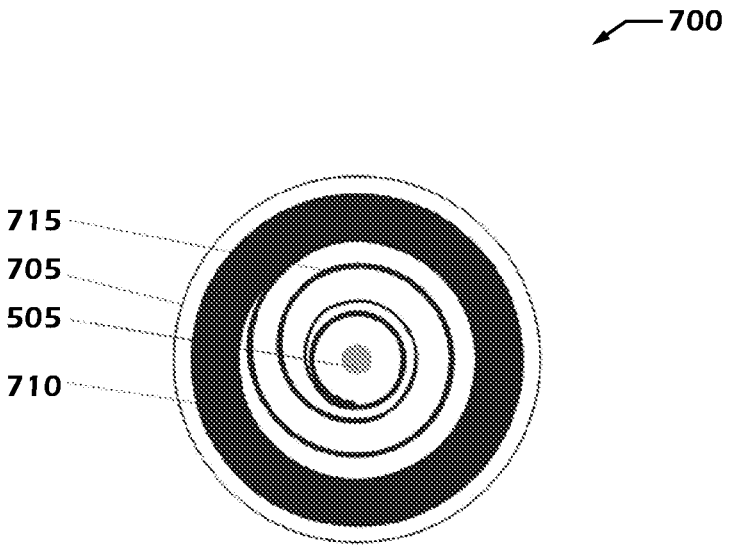
FIG. 4 illustrates a top view of a power-spring mechanism in accordance with an example embodiment.

FIG. 4 provides a top view of a power-spring mechanism 700 in accordance with an example embodiment. In various example embodiments, the power-spring 715 provides a constant spring force against the rotational direction of the ratchet 610. The power-spring 715 is concentric with the drive shaft 505 of the positive-displacement mechanism 500. The power-spring 715 allows the ratchet 610 to spring back to its initial orientation if the pawl 615 does not reach the next gear lobe following a partial rotation of the ratchet 610.

In an example embodiment, the power-spring 715 is fully coiled, resting on the internal wall 710 of the power-spring housing 705, wherein a fully coiled power-spring 715 is compressed without slack. In an example embodiment, the power-spring 715 is wound like a tape measure.

Example Sensing System

In various embodiments, the dispenser 10 comprises a sensing system. In various embodiments, the sensing system is configured to receive signal of a dispense trigger identified and relay to the microprocessor 520, comprising at least one sensor 410. In various embodiments, the sensing system is disposed within and/or part of the main housing 110.

In various example embodiments, the dispenser 10 electromechanically dispenses a contained cleaning medium. In an example embodiment, the pump motor 305 and servo motor 515 are powered individually via electrical wires routed throughout the cover housing 100 material. In an example embodiment, the dispenser is activated via a sensor 410 (e.g., infrared (IR), motion, LiDAR, radar, ultrasonic, etc.) configured in the design of the cover housing 100. In an example embodiment, the electrical power comes from a power supply (e.g., photovoltaic panels 405, battery bank, standardized power receptacle, etc.). In an example embodiment, photovoltaic panels 405 may be configured at the topmost region of the upper housing 105 to generate electrical power.

In an example embodiment, wherein the cover housing 100 is configured with detachable upper housing 105, main housing 110, and base housing 115 sections, electrical power connections may be configured to align and/or mesh with the attachment surfaces accordingly. In an example embodiment, the detachable electrical connections may be configured as power and/or signal contactors and/or the like.

Example Electrical Power System

In various embodiments, the dispenser 10 comprises and/or is in electrical communication with a power supply. For example, the power supply is configured to power the electrical components of the dispenser 10 such as the sensor 410, microprocessor 520, servo motor 515, pump motor 315, and/or the like.

In an example embodiment, the power supply is a photovoltaic panel 405 or an array thereof. For example, in an example embodiment, a photovoltaic panel 405 supplied power source configuration may be most applicable for an outdoor and/or mobile dispenser application. In an example embodiment, a battery supplied power source configuration may be most applicable for a mobile dispenser and/or a dispenser without access to a standardized power receptacle. In an example embodiment, a standardized power receptacle supplied power source configuration may be most applicable for a stationary dispenser and/or a dispenser with ease of access to a standardized power receptacle.

In an example embodiment, a dispenser may be configured with one or any combination of photovoltaic panel 405 supplied power source, battery supplied power source, standardized power receptacle supplied power source configurations, hardwired to line voltage, and/or the like.

Additional Example Embodiments

In an example embodiment, a cover housing 100 is incorporated into the structural design of the dispenser. The cover housing 100 provides an outer surface with internal structure and support for various mechanisms, devices, and electrical components. In an example embodiment, the cover housing 100 is a single body fixture formed around the components previously described In an example embodiment, an upper housing 105 is incorporated into the design of the cover housing 100, providing a removable top to access various mechanisms, devices, and electrical components. In an example embodiment, the upper housing 105 supports the retaining-ejecting mechanism 200, the dispensing mechanism 300, the electrical power system 400, and the topmost portion of the positive-displacement mechanism 500.

In an example embodiment, a main housing 110 is incorporated into the design of the cover housing 100, providing a cavity for a dilution chemical in a storage reservoir 120. In an example embodiment, the positive displacement mechanism 500, is oriented through the center of the main housing 110, extending from the upper housing 105 to the bottommost portion of the main housing 110. The main housing 110 also provides support for the sensing system, including a sensor 410 used to receive signal for activation of the dispenser.

In an example embodiment, a base housing 115 is incorporated into the design of the cover housing 100, providing a removable base to access various mechanisms, devices, and electrical components. In an example embodiment, the base housing 115 supports the servo motor 515, microprocessor 520, at least one activation rod 510, ratcheting mechanism 600, and power-spring mechanism 700. In an example embodiment, the base housing 115 supports the translation of power from the servo motor 515 to the positive-displacement mechanism 500 through the upper surface of the base housing 115. The axial drive of the positive-displacement mechanism 500 is supported concentrically with a bearing at the bottommost portion of the base housing 115 inner structure.

In an example embodiment, a storage reservoir 120 is configured in the design of the main housing 110 to retain the dilution chemical prior to and after dilution and/or deconcentrated of an applied concentrated cleaning medium.

In an example embodiment, a retaining-ejecting mechanism 200 is configured in the inner structure of the upper housing 105. The retaining-ejecting mechanism is configured to enable a concentrated cleaning pod 205 to be inserted into a retained position at least partially within the recess, retained in the retained position, and released from the retained position. In an example embodiment, the retaining-ejecting mechanism 200 is configured with a puncture tool to release the concentrated cleaning medium from the pod 205 as inserted into the retained position of the retaining-ejecting mechanism.

In an example embodiment, a pod 205 is configured with a puncturable cavity comprising a concentrated cleaning medium therein. In an example embodiment, the pod 205 is designed to be placed into the retaining-ejecting mechanism 200, held in the retained position, and removed after expelling the concentrated cleaning medium via gravitational force. In an example embodiment, the pod 205 releases the concentrated cleaning medium into the storage reservoir comprising the dilution chemical therein. In an example embodiment, the concentrated cleaning medium may be diluted into the dilution chemical, generating the diluted and/or deconcentrated cleaning solution. In an example embodiment, the positive-displacement mechanism 500 may be actuated temporarily to accelerate the mixing process of the concentrated cleaning medium into the dilution chemical.

In an example embodiment, a dispensing mechanism 300 comprises a pump motor 305 and a dispenser discharge 310. In an example embodiment, a holding reservoir 315 is also incorporated to provide a localized reservoir for the pump motor 305 to withdraw diluted and/or deconcentrated cleaning solution.

In an example embodiment, a pump motor 305 is configured to expel diluted and/or deconcentrated cleaning solution from the holding reservoir 315 out of the dispenser discharge 310. In an example embodiment, the pump motor 305 is a submerged pump configured to reside under the surface of the cleaning solution in the holding reservoir 120. In an example embodiment, the pump motor 305 may include a sensor to indicate low fluid level in the holding reservoir 120. In an example embodiment, the low fluid level indicator may be a predetermined output following the calculated number of activations of the pump motor 305 being met. In an example embodiment, the microprocessor 520 determines that the holding reservoir 315 is to be refilled following indication. In an example embodiment, indication that the holding reservoir 315 is to be refilled may follow a fluid level sensor in the holding reservoir 315, a count of dispenses since previous refill, or the like.

In an example embodiment, a dispenser discharge 310 is configured to be removable and/or interchangeable to best fit the intended application or to meet specified requirements. In an example embodiment, applications may include hand spouts for liquid cleaning solution, foaming dispensers for skin and/or abrasive surfaces, and the like. In an example embodiment, the removable dispenser discharge 310 is configured as a threaded fixture, properly mounting into the upper housing 105 to eliminate potential leaking. In an example embodiment, the threading type is configured as a national pipe tapered (NPT). In an example embodiment, the removable dispenser discharge 310 is configured as a press-fit mount to quickly release and/or interchange dispenser discharges 310 as required.

In an example embodiment, a holding reservoir 315 is incorporated in the design of the upper housing 105 provide a localized volume of cleaning solution easily accessible for the pump motor 305. In an example embodiment, the localized volume of cleaning solution eliminated the need for a higher-powered pump motor, drawing cleaning solution from the bottom of the storage reservoir 120 within the main housing 110. The holding reservoir 315 provides a lowered pressure and lessen head losses for the pump motor 305.

In an example embodiment, an electrical power system 400 provides current and directs signal via electrical wires and connections throughout the cover housing 100 body. In an example embodiment, the electrical power system 400 may be configured as a solar-charged dispenser via at least one photovoltaic panel incorporated in the design of the upper housing 105. In an example embodiment, the electrical power system 400 may be configured as a battery-bank dispenser via at least one battery supply incorporated in the design of the upper housing 105, main housing 110, and/or base housing 115. In an example embodiment, the electrical power system 400 may be configured as a standardized power receptacle system incorporated in the design of the upper housing 105 and or base housing 115.

In an example embodiment, the electrical power system 400 includes a back-up batter supply with a charging system via a standardized power receptacle. In an example embodiment, an AC/DC converter is configured to produce direct current (DC) from the standardized alternating current (AC) in most applications. In an example embodiment, the electrical power system 400 supplies the correct voltage and current to all individual components required to effectively operate the automated features of the disclosed dispenser.

In an example embodiment, a sensor 410 is configured to detect activation of a dispense trigger. In an example embodiment, the sensor 410 is an infrared (IR) sensor to detect the presence of a user. The identification of the dispense trigger being activated is processed via a microprocessor 520 to accordingly dispense cleaning solution as directed.

In an example embodiment, a positive-displacement mechanism 500 is configured to refill the holding reservoir 315 with the contents of the storage reservoir 120 following indication of a low-level alert of a sensor configured in the holding reservoir 315 and/or as part of the pump motor 305 functionality. In an example embodiment, the microprocessor may enable the servo motor 515 to actuate the positive displacement mechanism 500.

In an example embodiment, a drive shaft 505 concentrically aligns the positive-displacement mechanism 500 within the constraints of the upper housing 105, the storage reservoir 120 cavity of the main housing 110, and the bearing support of the base housing 115.

In an example embodiment, at least one activation rod 510 is incorporated to electromechanically disable, remove, and/or reset the pawl 615 feature of the ratcheting mechanism 600. In an example embodiment, the disabling of the pawl 615 allows the ratchet 610 to free spin in any direction provided force from the servo motor 515. In an example embodiment, a free spinning, non-ratcheting positive displacement mechanism 500 may pose useful in aims to free a clog in the dispensing mechanism 300, positive-displacement mechanism 500 screw pump, and/or to quickly mix the contents of the concentrated cleaning medium pod 205 with the dilution chemical within the storage reservoir 120. This action may be required periodically depending on the particular cleaning solution to maintain aeration, potency, and/or viscosity in accordance with an example embodiment.

In an example embodiment, a servo motor 515 is configured to electromechanically actuate the positive-displacement mechanism 500. In an example embodiment, the servo motor 515 is driven by a microprocessor 520 incorporated into the design of the servo motor 515 housing. In an example embodiment, the servo motor 515 is configured in the internal structure of the base housing 115, actively meshed via direct drive and/or gearset to the positive-displacement mechanism 500 axial drive shaft 505.

In an example embodiment, a microprocessor 520 controls the automation of the dispenser and directs signals from sensor inputs to actuator outputs, accordingly. In an example embodiment, the microprocessor 520 comprises features to at least refill the holding reservoir 315 with contents of the storage reservoir 120, receive signal from the at least one sensor 410, toggle between servo motor 515 gearsets, and dispense cleaning solution out of the dispenser discharge 310.

In an example embodiment, a ratcheting mechanism 600 is configured to provide full rotation of the positive-displacement mechanism 500 following a sequence of partial rotations of the servo motor 515. In an example embodiment, the servo motor 515 may not be configured to actuate a full rotation (i.e., 360 degrees). In an example embodiment, the ratcheting mechanism 600 allows the servo motor 515 to complete a partial rotation, reaching at least one pawl 615 integration with the ratchet 610, thus rotating the positive-displacement mechanism 500. The partial rotation of the servo motor 515 may be completed in a sequence calculated to total the full rotation of the positive-displacement mechanism 500. In an example embodiment, the sequence totaling a full rotation of the positive-displacement mechanism 500 may be tasked a desired number of times to appropriately refill the holding reservoir 315, mix the concentrated cleaning medium into the dilution chemical within the storage reservoir 120, and/or various additional features.

In an example embodiment, a gear 605 provides a toothed surface used to determine the precise orientation of the ratcheting mechanism 600 at any given time. In an example embodiment, an encoder may be implemented to provide output encoder counts to the microprocessor for position calculation. In an example embodiment, the gear 605 may also be used as a gear multiplier to increase or reduce the speed of the positive-displacement mechanism 500.

In an example embodiment, a ratchet 610 is configured with a plurality of sears to integrate with the at least one pawl 615. In an example embodiment, the rotation of the ratchet 610 directly drives the drive shaft for the positive-displacement mechanism 500. In an example embodiment, the pawl 615 is spring loaded to apply pressure against at least one ratchet 610 sear when forces in the opposing direction of desired rotation.

In an example embodiment, at least one servo pin connection 620 is configured to provide a removable and/or interchangeable pawl 615 assembly. The servo pin connection 620 may be used to actuate the ratchet 610 in accordance with an example embodiment.

In an example embodiment, a power-spring mechanism 700 is integrated in the base housing 115 to apply opposing rotational force against the ratcheting mechanism 600 to rotate the ratchet 610 back against at least one pawl 615 following the disengaging of the servo motor 515. In an example embodiment, when the servo motor 515 is disengaged, the lack of current flow to the motor produces a free-spin state of the servo motor 515. In an example embodiment, the power-spring mechanism 700 is used to counter the free-spin state of the disengaged servo motor 515 by resting the ratchet 610 against the at least one pawl 615 (i.e., a known orientation).

In an example embodiment, a power-spring housing 705 comprises the power-spring mechanism 700, providing a containing structure. In an example embodiment, given the nature of an expanding power-spring, the power spring mechanism 700 requires containment to function properly and force the ratchet 610 back against the at least one pawl 615. In an example embodiment, the power-spring mechanism 700 coils against the internal wall 710 of the power-spring housing 705.

Figure 5:
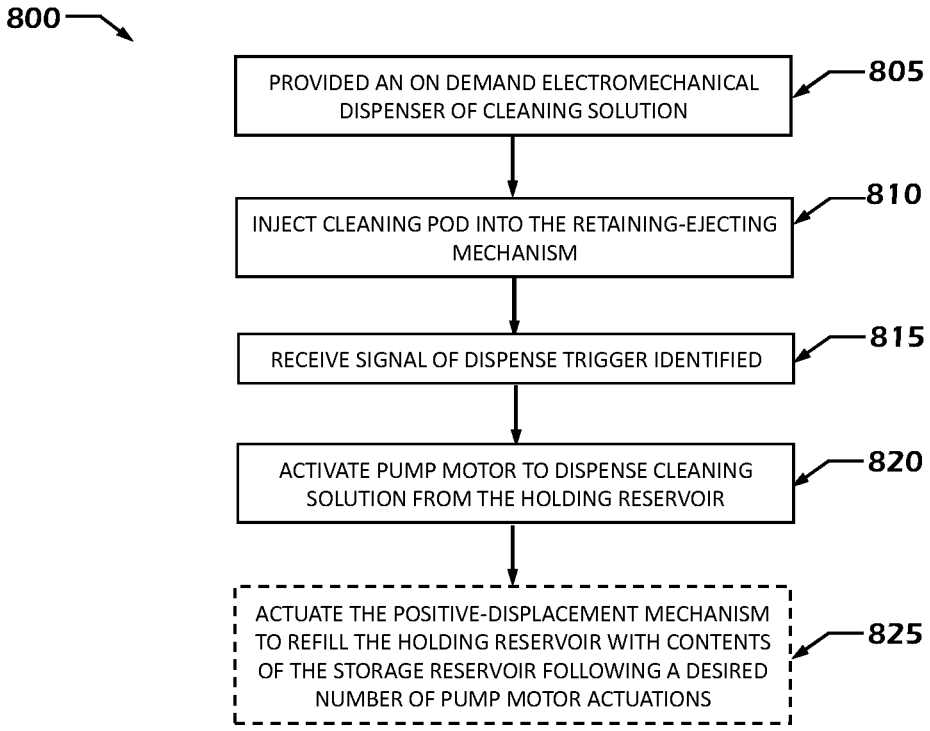
FIG. 5 provides a flowchart illustrating the process for automatically dispensing a cleaning solution after receiving signal of a dispense trigger being identified in accordance with example embodiments.

FIG. 5 provides a methodology 800 for automatically dispensing a cleaning solution. In an example embodiment, the methodology 800 comprises the steps required to effectively perform the automated dispensing of a cleaning solution. In an example embodiment, the first step 805 is to acquire the on demand electromechanical dispenser 10. In an example embodiment, the second step 810 is to place the concentrated cleaning pod 205 into the retained position of the retaining-ejecting mechanism 200. For example, a user may place a concentrated cleaning pod 205 into the recess 210 of the retaining-ejecting mechanism 200 and press the concentrated cleaning pod 205 into the retained position of the retaining-ejecting mechanism 200. Pressing the concentrated cleaning pod 205 into the retaining-ejecting mechanism 200 causes concentrated cleaning solution to be released from the concentrated cleaning pod 205 and provided to the storage reservoir 120.

In various embodiments, a user provides dilution chemical and/or liquid into the storage reservoir 120 prior to pressing the concentrated cleaning pod 205 into the retaining-ejecting mechanism 200. In various embodiments, the dilution chemical and/or liquid comprises water, ionized water, rubbing alcohol, and/or other solvent.

In an example embodiment, the third step 815 is to receive and process a sensor 410 signal indicating an identified dispense trigger. In an example embodiment, the microprocessor 520 receives signal from at least one sensor 410 following a user providing appropriate motion in front of the at least one sensor 410. In an example embodiment, the provided sensor 410 is a short-range motion sensor.

In an example embodiment, the fourth step 820 is to actuate the pump motor 305 to dispense a single-use amount of cleaning solution from the holding reservoir 315. In an example embodiment, the microprocessor 520 actuates the pump motor 305 following the received signal of a dispense trigger identified via the at least one sensor 410.

In an example embodiment, an optional fifth step 825, provides a feature to actively refill the holding reservoir 315 with contents of the storage reservoir 120 following a desired number of pump motor 305 actuations. In an example embodiment, the microprocessor 520 activates the servo motor 515 to cause the positive-displacement mechanism 500 to actuate. In an example embodiment, the actuation of the positive-displacement mechanism 500 is configured to transport cleaning solution from the storage reservoir 120 to the holding reservoir 315. In an example embodiment, the microprocessor 520 causes the holding reservoir 315 to be refilled with cleaning solution from the storage reservoir 120 following the indication of a low-level alert via a sensor 410 disposed in and/or coupled to the holding reservoir 315. In an example embodiment, indication that the holding reservoir 315 is to be refilled may follow a fluid level sensor in the holding reservoir 315, a count of dispenses since previous refill, or the like.

CONCLUSION

Accordingly, the reader will see that, according to the invention, example embodiments relating in general to electromechanical dispensers of cleaning solutions via a positive-displacement mechanism. The provided example embodiments indicate the usefulness of the present invention, allowing a non-user-aided and on-demand electromechanical dispenser of a cleaning solution to minimize financial and carbon footprint costs of cleaning products.

While the above drawings and descriptions contain many specificities, these should not be construed as limitations on the scope of this invention, but rather as an exemplification of one preferred embodiment thereof. Accordingly, the scope of the invention should be determined not by the embodiments illustrated, but by the appended claims and their legal equivalents.

That which is claimed:

1. A dispenser comprising:

a cover housing comprising:

an upper housing comprising:

a dispensing mechanism configured to electromechanically dispense cleaning solution from a holding reservoir;

a main housing comprising:

a cleaning solution storage reservoir, and a positive-displacement mechanism configured to electromechanically transport cleaning solution from the storage reservoir to the holding reservoir;

a base housing comprising:

a ratcheting mechanism configured to cause the positive-displacement mechanism to rotate in a single defined rotational direction, and a power-spring mechanism configured to generate resistance against the ratcheting mechanism;

a microprocessor configured to:

receive a signal indicating a sensing system has identified a dispense trigger, relay a signal to a pump motor to operate accordingly, determine that the holding reservoir is to be refilled, and actuate the positive-displacement mechanism to refill the holding reservoir accordingly;

an electrical power system configured to supply electrical power to components of the dispensing mechanism, the positive-displacement mechanism, and the microprocessor.

2. The dispenser according to claim 1, wherein the positive-displacement mechanism is configured on an axial drive shaft.

3. The dispenser according to claim 2, wherein the axial drive shaft extends from the upper housing, through the main housing, to the base housing.

4. The dispenser according to claim 3, wherein the axial drive shaft is electromechanically coupled to a servo motor in the base housing.

5. The dispenser according to claim 4, wherein the servo motor is powered by the electrical power system comprising a battery bank.

6. The dispenser according to claim 5, wherein the battery bank is charged via at least one photovoltaic panel.

7. The dispenser according to claim 1, wherein the dispensing mechanism comprises:

the pump motor, and a dispenser discharge.

8. The dispenser according to claim 7, wherein the dispenser discharge is configured to dispense cleaning solution as a hand spout or nozzle.

9. The dispenser according to claim 8, wherein the pump motor is powered by the electrical power system.

10. The dispenser according to claim 9, wherein the electrical power system is powered by a battery bank.

11. The dispenser according to claim 10, wherein the battery bank is charged via at least one photovoltaic panel.

12. The dispenser according to claim 1, wherein the upper housing is mechanically fixed to the main housing via an attachment surface shared between the upper housing and the main housing.

13. The dispenser according to claim 1, wherein the main housing is mechanically fixed to the base housing via an attachment surface shared between the main housing and the base housing.

14. The dispenser according to claim 1, wherein the ratcheting mechanism is configured with at least one activation rod.

15. The dispenser according to claim 14, wherein the activation rod is configured as a toggleable switch to provide a simplified reversal of the ratcheting mechanism direction.

16. The dispenser according to claim 15, wherein the activation rod is configured as a toggleable switch to toggle between various gear ratios, thus changing the torque output and speed of the positive displacement mechanism.

17. The dispenser according to claim 1, wherein the power-spring provides a constant spring force against the rotational direction of the ratchet.

18. The dispenser according to claim 1, wherein the upper housing comprises a retaining-ejecting mechanism, wherein the retaining-ejecting mechanism enables a concentrated cleaning pod to be inserted into a retained position at least partially within the recess, retained in the retained position, and released from the retained position.

19. A method for automatically dispensing a cleaning solution, the method comprising:

providing an on-demand electromechanical dispenser of cleaning solution, the dispenser comprising:

a cover housing comprising:

an upper housing comprising:

a dispensing mechanism configured to electromechanically dispense cleaning solution from a holding reservoir;

a main housing comprising:

a cleaning solution storage reservoir, and a positive-displacement mechanism configured to electromechanically transport cleaning solution from the storage reservoir to the holding reservoir;

a base housing comprising:

a ratcheting mechanism configured to allow the positive-displacement mechanism to rotate in a single rotational direction, and a power-spring mechanism configured to generate resistance against the ratcheting mechanism; and a microprocessor, receiving, by the microprocessor, a signal indicating identification of a dispense trigger, causing, by the microprocessor, activation of a pump motor to dispense cleaning solution from the holding reservoir, and causing, by the microprocessor, activation of the positive-displacement mechanism to refill the holding reservoir with contents of the storage reservoir.

20. The dispenser according to claim 19, wherein the dispenser is configured to dispense a single use amount of cleaning solution per dispense event.

* * * * *